US011509097B2

(12) United States Patent
Fukatsu et al.

(10) Patent No.: US 11,509,097 B2
(45) Date of Patent: Nov. 22, 2022

(54) CONNECTOR

(71) Applicant: SUMITOMO WIRING SYSTEMS, LTD., Mie (JP)

(72) Inventors: Yukihiro Fukatsu, Mie (JP); Toshikazu Sakurai, Mie (JP); Shinji Iihoshi, Mie (JP); Takeshi Suzuki, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/408,848

(22) Filed: Aug. 23, 2021

(65) Prior Publication Data

US 2022/0069524 A1 Mar. 3, 2022

(30) Foreign Application Priority Data

Aug. 27, 2020 (JP) ..... JP2020-143811

(51) Int. Cl.

| | |
|---|---|
| ***H01R 13/639*** | (2006.01) |
| ***H01R 13/629*** | (2006.01) |
| ***H01R 13/627*** | (2006.01) |
| ***H01R 13/506*** | (2006.01) |

(52) U.S. Cl.

CPC ..... *H01R 13/639* (2013.01); *H01R 13/506* (2013.01); *H01R 13/629* (2013.01); *H01R 13/6271* (2013.01)

(58) Field of Classification Search

CPC ..... H01R 13/639; H01R 13/506; H01R 13/136271; H01R 13/629; H01R 13/514; H01R 24/28

See application file for complete search history.

(56) References Cited

U.S. PATENT DOCUMENTS

| | | | | |
|---|---|---|---|---|
| 7,695,315 | B2 * | 4/2010 | Hitchcock | H01R 13/4223 439/701 |
| 8,215,984 | B2 | 7/2012 | Yokozeki | |
| 9,722,347 | B2 | 8/2017 | Chikusa et al. | |
| 10,700,467 | B2 * | 6/2020 | Chikusa | H01R 13/422 |
| 2019/0267746 | A1 * | 8/2019 | Chikusa | H01R 13/4223 |
| 2021/0167543 | A1 * | 6/2021 | Oka | H01R 13/514 |

* cited by examiner

*Primary Examiner* — Tho D Ta

(74) *Attorney, Agent, or Firm* — Venjuris, P.C.

(57) ABSTRACT

A connector includes a first housing and a second housing having facing surfaces facing each other. One of the first and second housings includes a receiving portion open forward in a front end part and the other includes a rotating portion to be arranged in the receiving portion in the front end part. The second housing is rotated with respect to the first housing about an axis passing through the rotating portion in the receiving portion along a width direction and is coupled to the first housing. The first housing includes a lock receiving portion open forward and rearward in the front end part. The second housing includes a locking portion projecting toward the first housing and to be fit to the lock receiving portion in the front end part. The locking portion includes a wide restricting portion, and the lock receiving portion includes a wide restriction receiving portion.

5 Claims, 13 Drawing Sheets

CONNECTOR

CROSS-REFERENCE TO RELATED APPLICATIONS

This application is based on and claims priority from Japanese Patent Application No. 2020-143811, filed on Aug. 27, 2020, with the Japan Patent Office, the disclosure of which is incorporated herein in their entireties by reference.

TECHNICAL FIELD

The present disclosure relates to a connector.

BACKGROUND

A connector disclosed in Japanese Patent Laid-open Publication No. 2010-153312 includes a lower housing (hereinafter, first housing) and an upper housing (hereinafter, second housing). The second housing is coupled to the first housing from above. With the first and second housings coupled, the upper surface of the first housing and the lower surface of the second housing are arranged to face each other.

A locking groove is provided to be open in a widthwise central side of the front surface of the second housing. A locking piece to be fit into the locking groove is provided on a widthwise central side of the facing surface of the first housing. Locking pieces are provided on side surfaces on both widthwise end sides of the second housing. Locking projections to be locked to the locking pieces are provided on side surfaces on both widthwise end sides of the first housing. Such a connector is also disclosed in Japanese Patent Laid-open Publication No. 2017-004737.

SUMMARY

In the case of Japanese Patent Laid-open Publication No. 2010-153312, when a worker pinches wires pulled out from the rear surfaces of the respective first and second housings, the first and second housings may be deformed by being pushed by the wires. For example, a relative positional relationship can be maintained by the locking of the locking pieces and the locking projections on both widthwise end sides of the first and second housings. However, the locking piece possibly comes out from the locking groove on the widthwise central parts of the first and second housings and there is a concern that so-called opening between the mutually facing surfaces (the upper surface of the first housing and the lower surface of the second housing) occurs.

Accordingly, the present disclosure aims to provide a connector capable of suppressing opening between mutually facing surfaces of a first housing and a second housing.

The present disclosure is directed to a connector with a first housing and a second housing having facing surfaces facing each other, wherein one of the first and second housings includes a receiving portion open forward in a front end part and the other includes a rotating portion to be arranged in the receiving portion in the front end part, the second housing is rotated with respect to the first housing about an axis passing through the rotating portion in the receiving portion along a width direction and is coupled to the first housing, the first housing includes a lock receiving portion open forward and rearward and recessed toward a side away from the second housing in the front end part, the second housing includes a locking portion projecting toward the first housing and to be fit to the lock receiving portion in the front end part, the locking portion includes a restricting portion wider than a base end side in a projecting direction on a tip side in the projecting direction, and the lock receiving portion includes a restriction receiving portion wider than an opening end side in a recess direction on a back end side in the recess direction.

According to the present disclosure, it is possible to provide a connector capable of suppressing opening between mutually facing surfaces of a first housing and a second housing.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
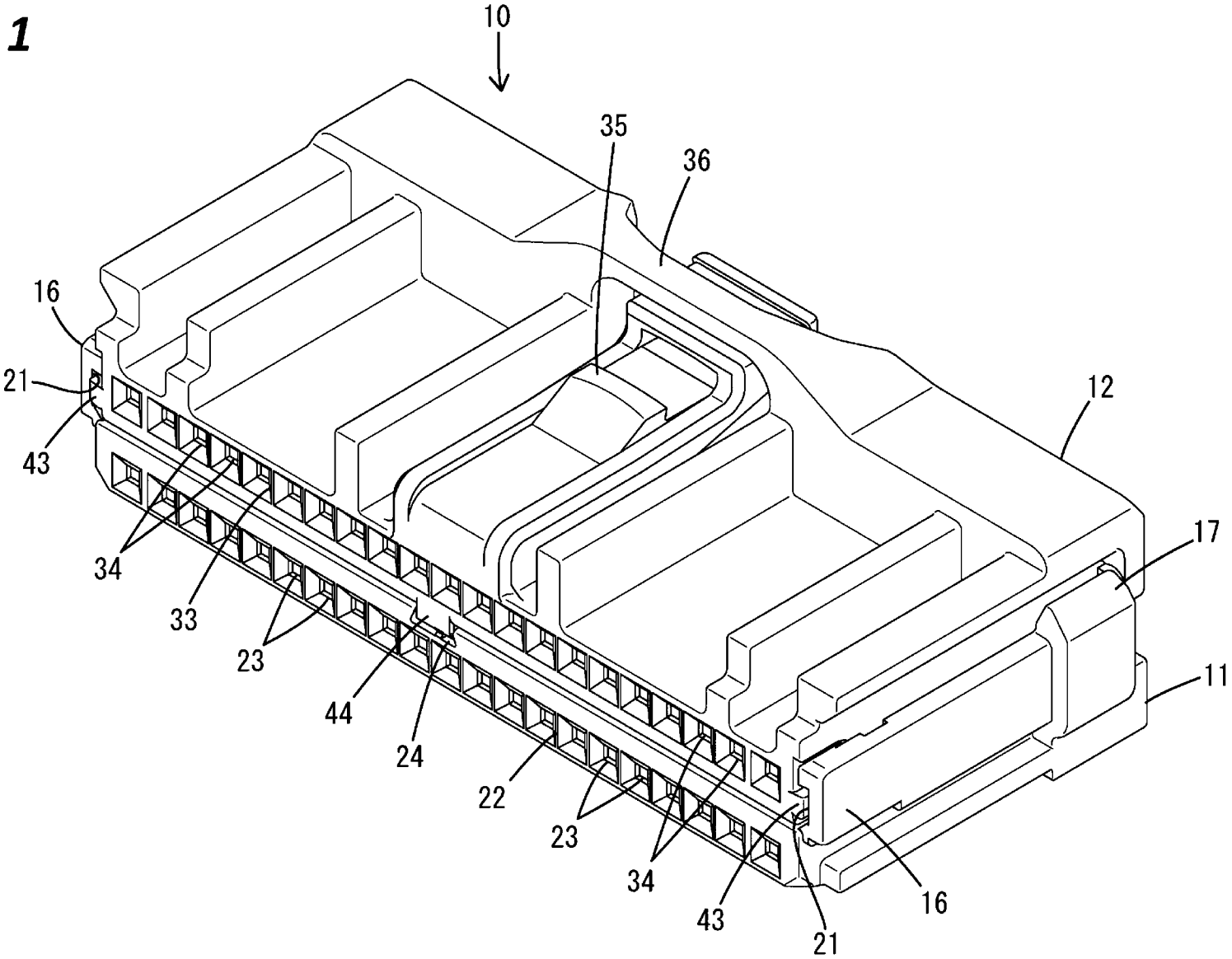
FIG. 1 is a perspective view of a connector according to one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

DESCRIPTION OF EMBODIMENTS OF PRESENT DISCLOSURE

First, embodiments of the present disclosure are listed and described.

(1) The connector of the present disclosure includes a first housing and a second housing having facing surfaces facing each other, wherein one of the first and second housings includes a receiving portion open forward in a front end part and the other includes a rotating portion to be arranged in the receiving portion in the front end part, the second housing is rotated with respect to the first housing about an axis passing through the rotating portion in the receiving portion along a width direction and is coupled to the first housing, the first housing includes a lock receiving portion open forward and rearward and recessed toward a side away from the second housing in the front end part, the second housing includes a locking portion projecting toward the first housing and to be fit to the lock receiving portion in the front end part, the locking portion includes a restricting portion wider than a base end side in a projecting direction on a tip side in the projecting direction, and the lock receiving portion includes a restriction receiving portion wider than an opening end side in a recess direction on a back end side in the recess direction.

According to the above configuration, the rotating portion is inserted into the receiving portion from front, and the locking portion is fit to the lock receiving portion and, consequently, the restricting portion is fit to the restriction receiving portion in conjunction with the rotation of the first and second housings about the axis passing through the rotating portion along the width direction. In this way, the restricting portion is locked to the restriction receiving portion and a clearance between the mutually facing surfaces of the first and second housings can be suppressed.

Note that, in the case of Japanese Patent Laid-open Publication No. 2010-153312 described above, since the first and second housings are brought closer and coupled to each other in the vertical direction, a structure for firmly locking the locking piece into the locking groove cannot be realized because the locking piece has to be fit into the locking groove, such as by being deflected and deformed.

(2) Preferably, the lock receiving portion is arranged on a central side in the width direction of the first housing and the locking portion is arranged on a central side in the width direction of the second housing, and the first housing includes first lock portions on both end sides in the width direction and the second housing includes second lock portions on both end sides in the width direction, the second lock portions being locked to the first lock portions to hold the first and second housings in a coupled state.

According to the above configuration, a relative positional relationship of the first and second housings can be maintained by the locking of the first and second lock portions on the both widthwise end sides of the first and second housings. Further, the relative positional relationship of the first and second housings can be maintained by the locking of the locking portion and the lock receiving portion on the widthwise central sides of the first and second housings. Thus, even if the first and second housings are shaped to be long in the width direction, the clearance between the mutually facing surfaces can be suppressed.

(3) A slope inclined forward may be provided on an end side on a tip side in the projecting direction of the restricting portion.

According to the above configuration, the interference of the slope of the restricting portion and the back surface of the restriction receiving portion can be avoided during the rotation of the first and second housings, and a rotating operation of the first and second housings can smoothly proceed.

(4) The slope of the restricting portion may be curved toward the back surface of the restriction receiving portion.

According to the above configuration, a displacement of the restricting portion can be guided along the curved shape of the slope. Further, the rigidity of the restricting portion is enhanced by as much as the slope is curved.

(5) Further, either one of the restriction receiving portion and the restricting portion may be provided with a protrusion projecting toward the other, and the other may be provided with a recess to be fit to the protrusion.

According to the above configuration, position shifts of the locking portion and the lock receiving portion in the width direction can be effectively suppressed by fitting the protrusion into the recess.

DETAILS OF EMBODIMENT OF PRESENT DISCLOSURE

A specific example of the present disclosure is described below with reference to the drawings. Note that the present invention is not limited to these illustrations and is intended to be represented by claims and include all changes in the scope of claims and in the meaning and scope of equivalents.

Embodiment

As shown in FIG. 1, a connector 10 of one embodiment includes a first housing 11 and a second housing 12 to be stacked on each other. The first and second housings 11, 12 are connected to an unillustrated mating housing while being coupled to each other. Note that, in the following description, a vertical direction is based on a vertical direction of each of FIGS. 1, 3, 4 and 6 to 13. A width direction is based on a lateral direction of each of FIGS. 2, 4, 5 and 12. A left side of each of FIGS. 8 to 11 and 13 is referred to as a front side concerning a front-rear direction. The mating housing is connected to the first and second housings 11, 12 in a coupled state from front.

(First Housing 11)

Figure 2:
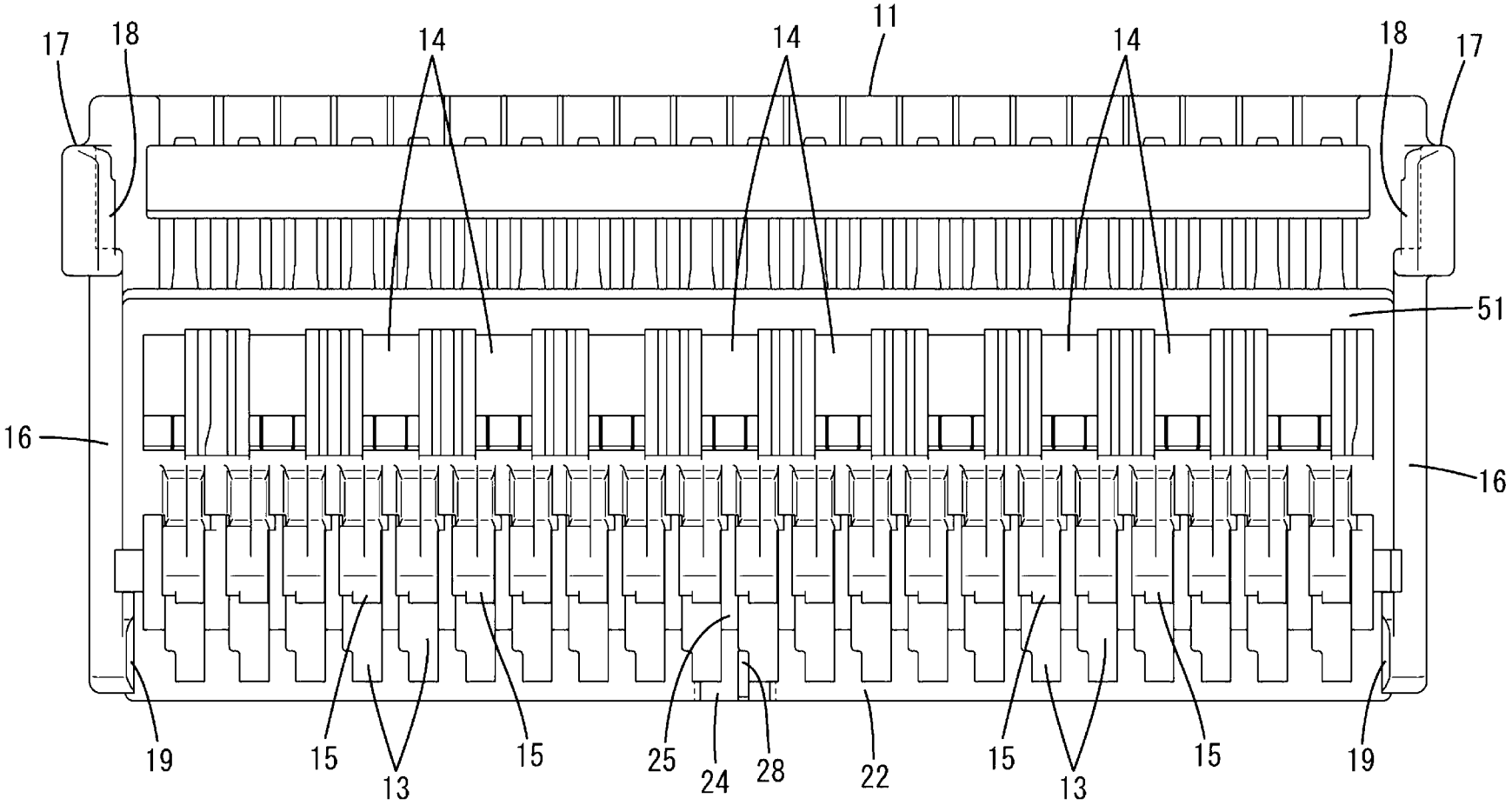
FIG. 2 is a plan view of a first housing.

The first housing 11 is arranged below the second housing 12. The upper surface of the first housing 11 serves as a facing surface 51 facing the second housing 12 to be able to contact the second housing 12. As shown in FIG. 2, the first housing 11 has a rectangular shape in a plan view and has a flat shape elongated in the width direction. The first housing 11 includes a plurality of first cavities 13. The respective first cavities 13 are partially open in the facing surface 51 of the first housing 11 and arranged side by side in the width direction.

The first housing 11 includes a plurality of first detecting portions 14. The respective detecting portions 14 project from the facing surface 51 of the first housing 11 and are arranged side by side in the width direction. Further, each first detecting portion 14 is arranged to straddle between the adjacent first cavities 13. The first housing 11 includes a plurality of first locking lances 15 in front of the respective first detecting portions 14. The respective first locking lances 15 are exposed on the facing surface 51 of the first housing 11 and arranged at positions corresponding to the first cavities 13.

Figure 13:
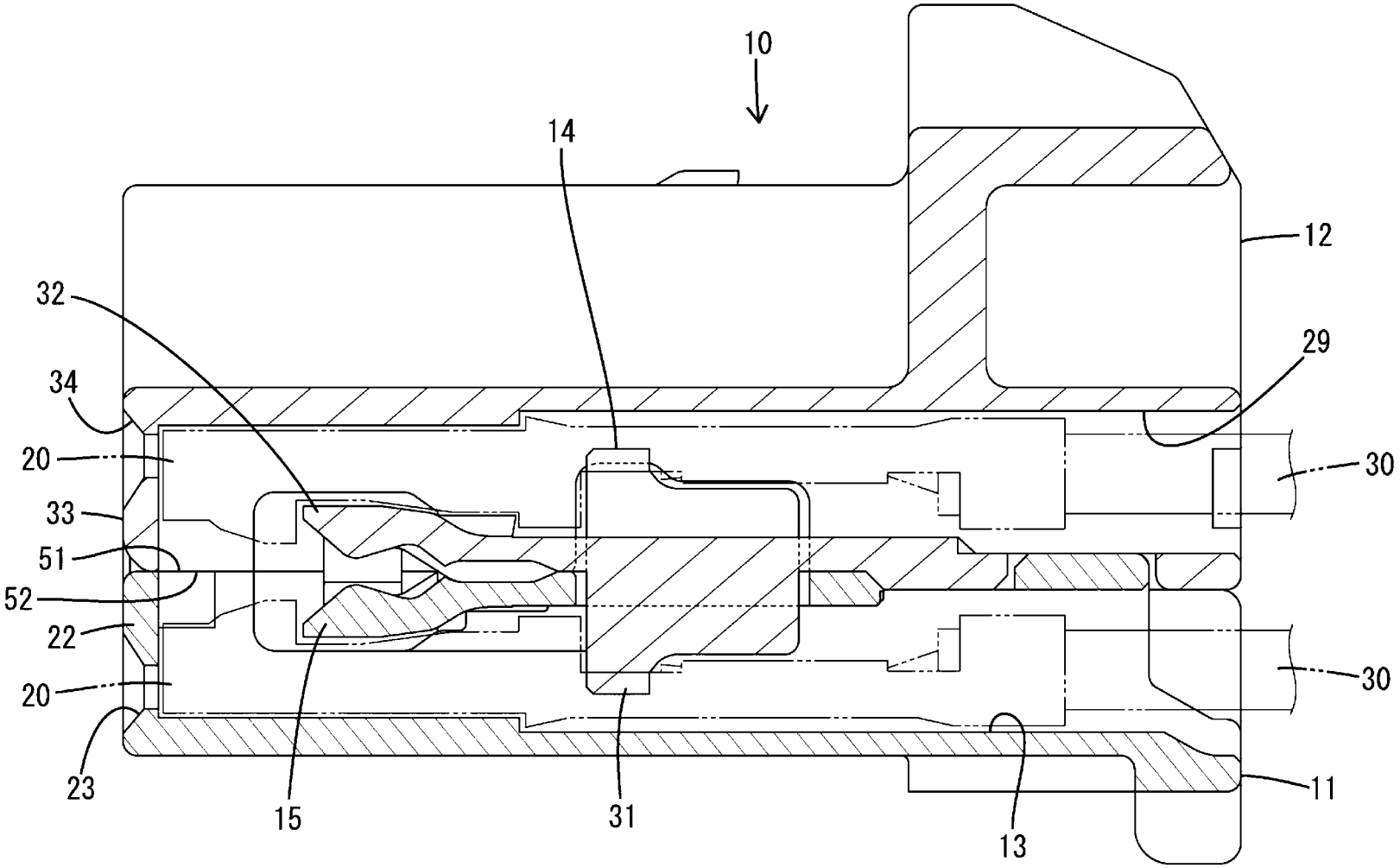
FIG. 13 is a side view in section of the connector.

As shown in FIG. 13, a terminal fitting 20 is inserted into the first cavity 13 from behind. The terminal fitting 20 is locked by the first locking lance 15, whereby escape from the first cavity 13 is restricted. The terminal fitting 20 is connected to an end part of a wire 30. The wire 30 is pulled out rearward from the rear surface of the first housing 11.

As shown in FIGS. 1 and 2, the first housing 11 includes a pair of side walls 16 rising upward on both widthwise end sides. Each side wall 16 has a plate shape extending in the front-rear direction. A first lock portion 17 is provided to project higher on a rear end part of each side wall 16. As shown in FIG. 2, a rib-like first lock projection 18 extending in the front-rear direction is provided on the inner surface of each first lock portion 17.

Figure 3:
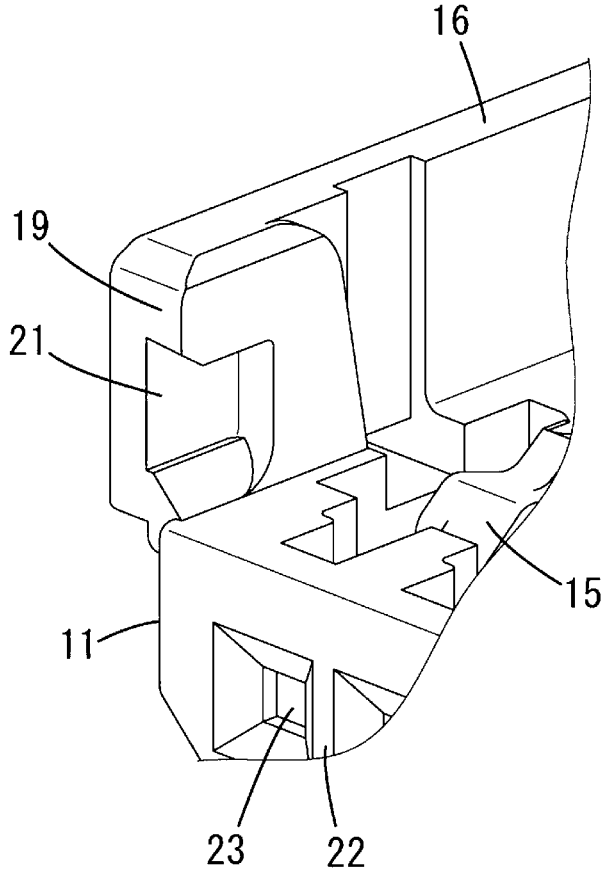
FIG. 3 is an enlarged perspective view of a first fulcrum portion provided on one end side, out of both widthwise end sides of the first housing.

As shown in FIG. 3, a thick first fulcrum portion 19 is provided on a front end part of each side wall 16. A cut-like receiving portion 21 is provided by recessing the inner surface of the first fulcrum portion 19. The receiving portion 21 is open on the front end of the side wall 16.

The first housing 11 includes a front wall 22 long in the width direction. A plurality of tab insertion openings 23 communicating with the respective first cavities 13 are provided to be open in the front wall 22. A tab of an unillustrated mating terminal fitting is inserted into each tab insertion opening 23 from front. The tab of the mating terminal fitting is electrically connected to the terminal fitting 20 arranged in the first cavity 13.

As shown in FIGS. 1 and 2, the first housing 11 includes a lock receiving portion 24 on a widthwise central side. The lock receiving portion 24 is provided by recessing the upper surface of the front wall 22. Further, the lock receiving portion 24 is provided from the front wall 22 to a separation wall 25 between the adjacent first cavities 13.

Figure 4:
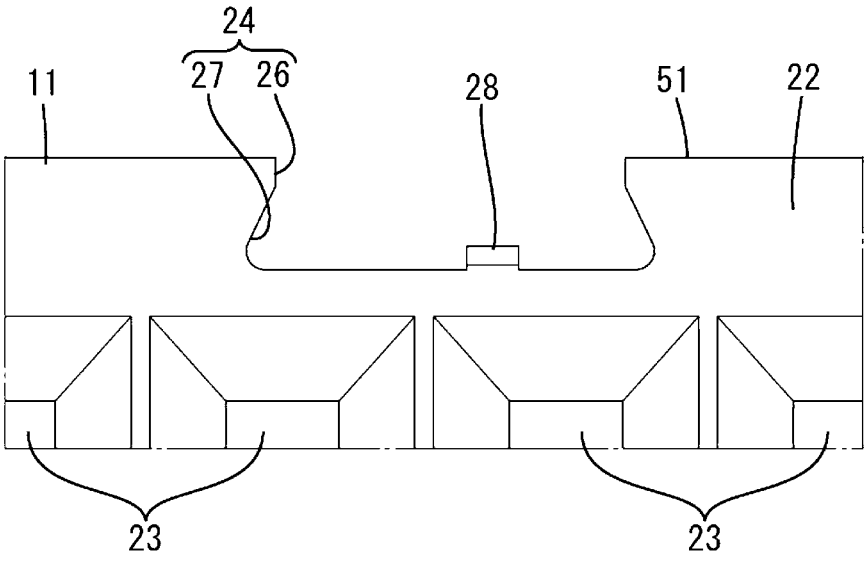
FIG. 4 is an enlarged front view of a lock receiving portion provided on a widthwise central side of the first housing.

As shown in FIG. 4, the lock receiving portion 24 penetrates through the front wall 22 in the front-rear direction and is open on an upper end and both front and rear sides. The lock receiving portion 24 includes an opening 26 on an upper end side (opening end side in a recess direction) and a restriction receiving portion 27 wider than the opening 26 on a lower end side (back end side in the recess direction). The opening 26 has a constant width in the vertical direction. The restriction receiving portion 27 is shaped to gradually increase a width from the opening 26 toward the back end side. A vertical dimension of the restriction receiving portion 27 is larger than that of the opening 26. In short, the lock receiving portion 24 is formed into a dovetail groove.

Figure 9:
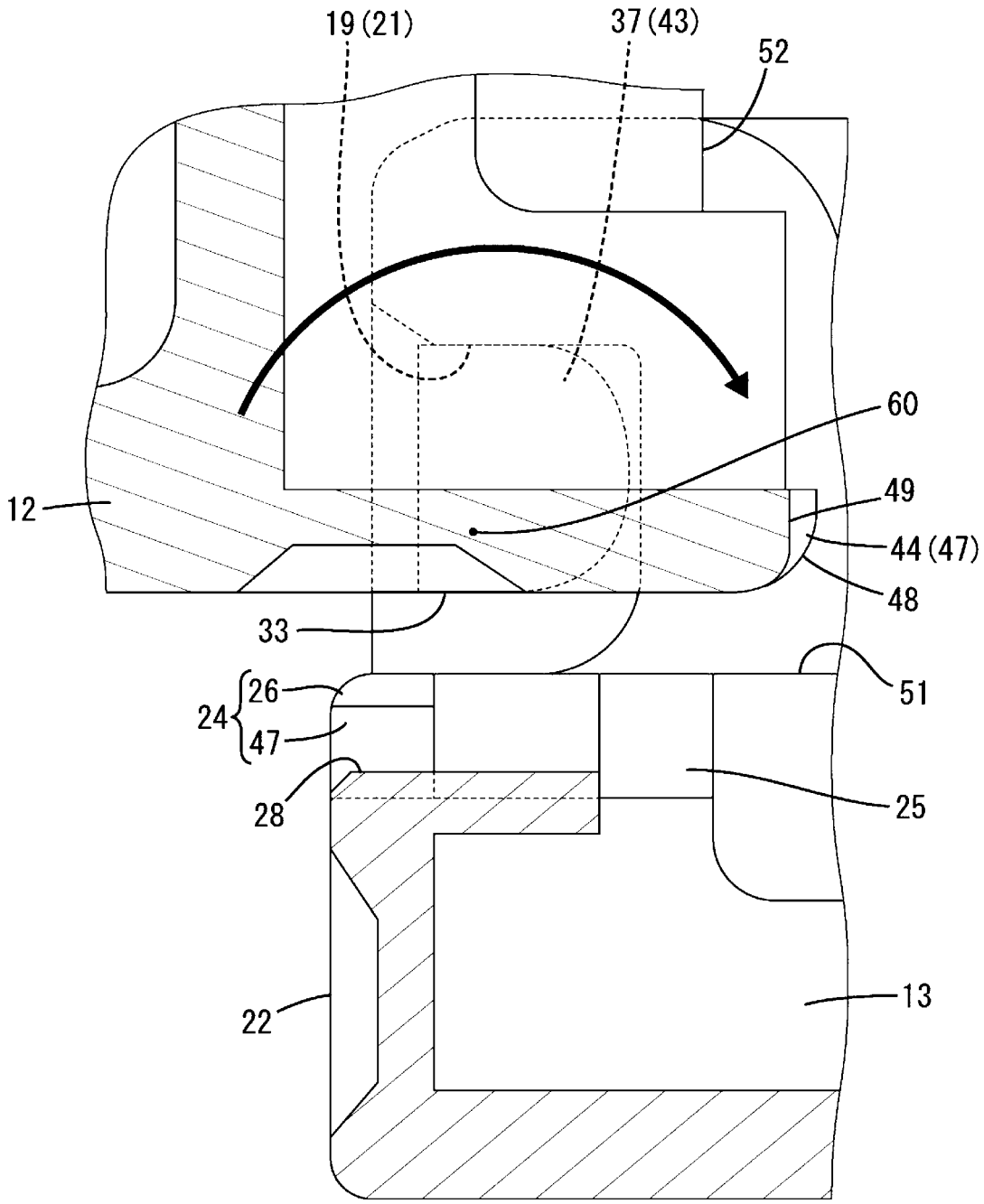
FIG. 9 is an enlarged section showing a state where the first and second housings are set at an initial position.

The back surface (surface on the back end side in the recess direction) of the restriction receiving portion 27 is arranged to be flat along the lateral direction. A rib-like protrusion 28 extending in the front-rear direction is provided to project on the back surface of the restriction receiving portion 27. As shown in FIG. 2, the protrusion 28 is coupled to the separation wall 25 on one widthwise side. As shown in FIG. 9, the protrusion 28 has a constant height in the front-rear direction except on a front end part. The front surface of the front end part of the protrusion 28 is facing the front surface of the front wall 22 and inclined upward.

(Second Housing 12)

Figure 5:
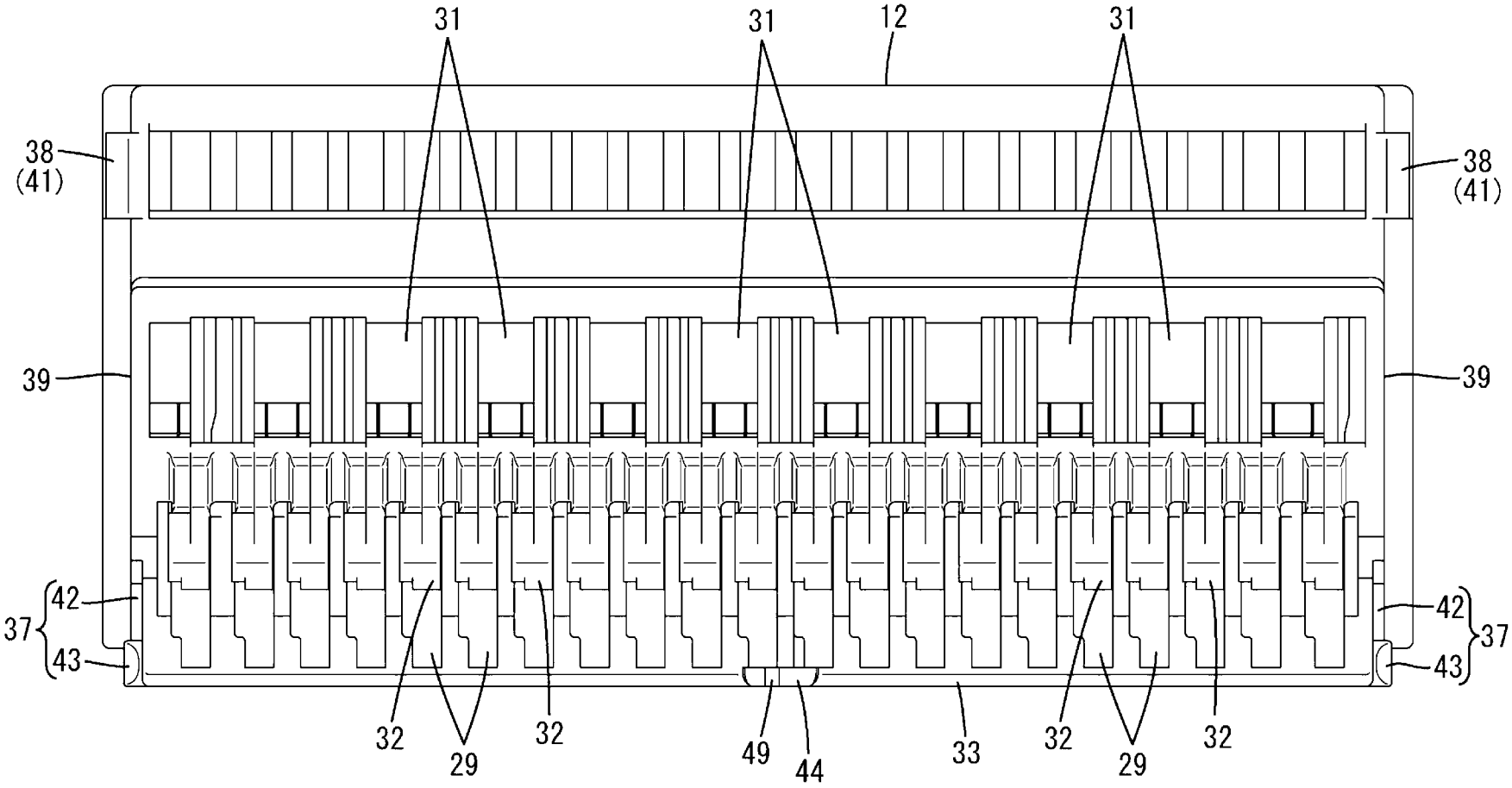
FIG. 5 is a bottom view of a second housing.

The second housing 12 is arranged above the first housing 11. The lower surface of the second housing 12 serves as a facing surface 52 facing the first housing 11 to be able to contact the first housing 11. As shown in FIG. 5, the second housing 12 has a rectangular shape in a bottom view and has a flat shape elongated in the width direction. The second housing 12 includes a plurality of second cavities 29. The respective second cavities 29 are partially open in the facing surface 52 of the second housing 12 and arranged side by side in the width direction.

The second housing 12 includes a plurality of second detecting portions 31. The respective detecting portions 31 project from the facing surface 52 of the second housing 12 and are arranged side by side in the width direction. Further, each second detecting portion 31 is arranged to straddle between the adjacent second cavities 29. The second housing 12 includes a plurality of second locking lances 32 in front of the respective second detecting portions 31. The respective second locking lances 32 are exposed on the facing surface 52 of the second housing 12 and arranged at positions corresponding to the second cavities 29. As shown in FIG. 13, the terminal fitting 20 is inserted into the second cavity 29 from behind. The terminal fitting 20 is structured as described above. Further, the second housing 12 includes a front wall 33 and a plurality of tab insertion openings 34 similar to those of the first housing 11.

As shown in FIG. 1, the second housing 12 includes a lock arm 35 projecting rearward from a front end part on a widthwise central side of an upper surface. The lock arm 35 locks the mating housing and holds the connector 10 and the mating housing in a connected state. The second housing 12 includes, on a rear end side, a rear wall 36 extending in the width direction while covering a rear end part of the lock arm 35.

As shown in FIG. 5, the second housing 12 includes second fulcrum portions 37 and second lock portions 38 on side surface portions 39 on both widthwise end sides. A pair of the second lock portions 38 are arranged on rear end sides of the respective side surface portions 39. The second lock portion 38 includes a rib-like second lock projection 41 extending in the front-rear direction on the side surface portion 39. The second lock projection 41 is lockable to the first lock projection 18.

Figure 6:
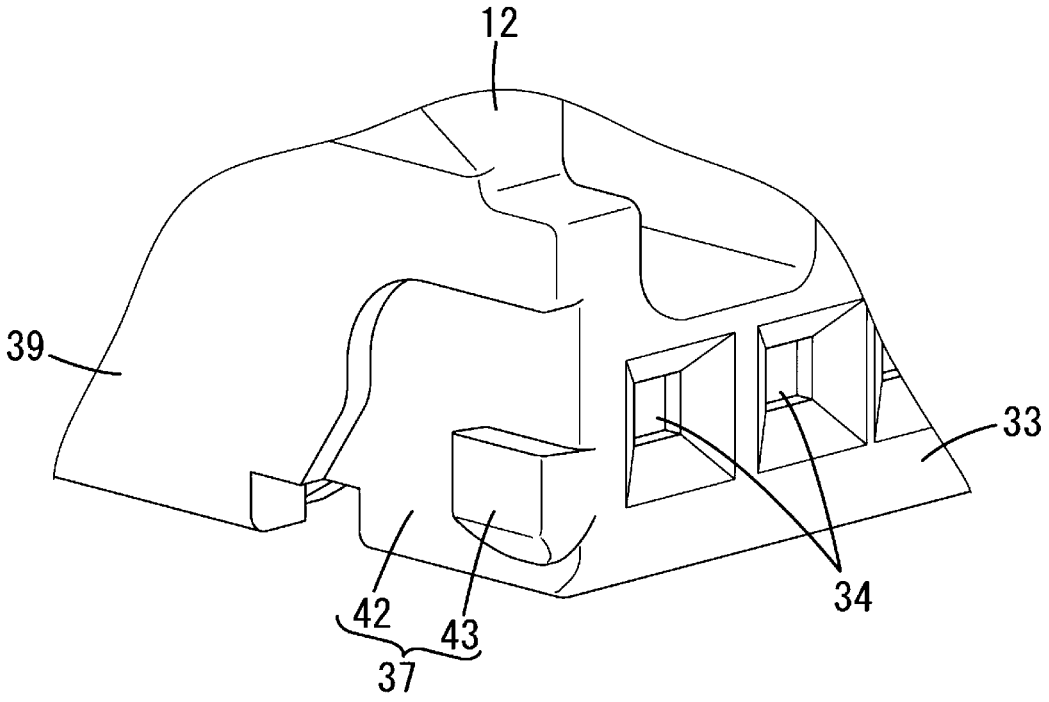
FIG. 6 is an enlarged perspective view of a second fulcrum portion provided on one end side, out of both widthwise end sides of the second housing.

A pair of the second fulcrum portions 37 are arranged on front end sides of the respective side surface portions 39. As shown in FIG. 6, the second fulcrum portion 37 includes a recessed groove 42 formed by recessing the side surface portion 39 and open on front and lower sides. The back surface of the recessed groove 42 is arranged vertically along the vertical direction. The second fulcrum portion 37 includes a rotating portion 43 in the form of a rectangular block. The front surface of the rotating portion 43 is facing the front surface of the second housing 12 and arranged vertically along the vertical direction. The upper, rear and lower surfaces of the rotating portion 43 constitute the inner peripheral surface of the recessed groove 42. The upper surface of the rotating portion 43 is arranged to be flat along the front-rear direction. The rear surface of the rotating portion 43 is arranged vertically along the vertical direction. The lower surface of the rotating portion 43 is arcuately curved downward as a whole.

Figure 7:
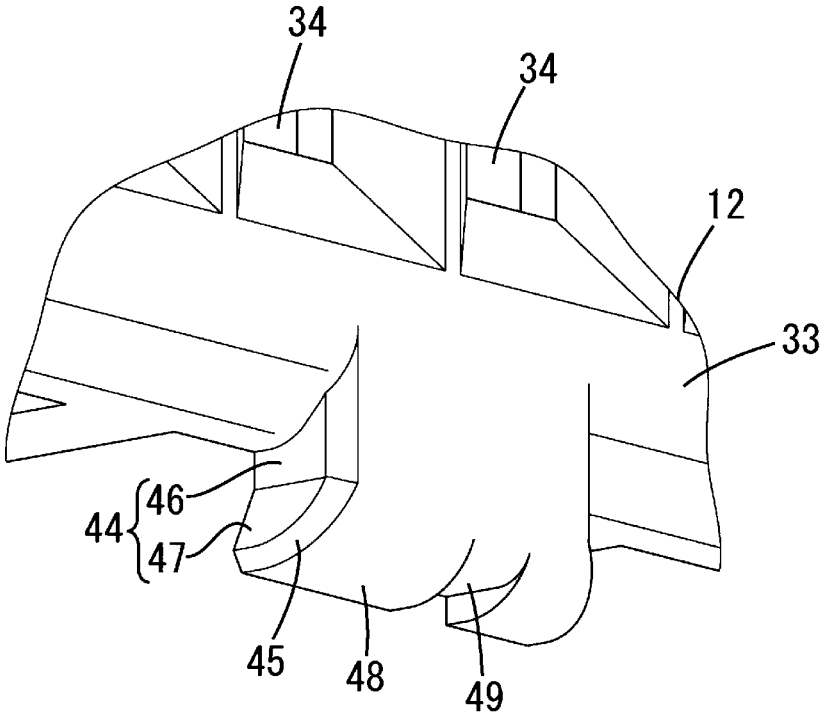
FIG. 7 is an enlarged perspective view of a locking portion provided on a widthwise central side of the second housing.

As shown in FIGS. 1 and 5, the second housing 12 includes a locking portion 44 on the widthwise central side. The locking portion 44 is provided to project on the lower surface of the front wall 33. A thickness in the front-rear direction of the locking portion 44 is equal to that of the front wall 33. As shown in FIG. 7, the front surface of the locking portion 44 is continuous with the front surface of the front wall 33 without any step. Chamfering 45 is applied to edge parts on both widthwise end sides of the front surface of the locking portion 44.

Figure 12:
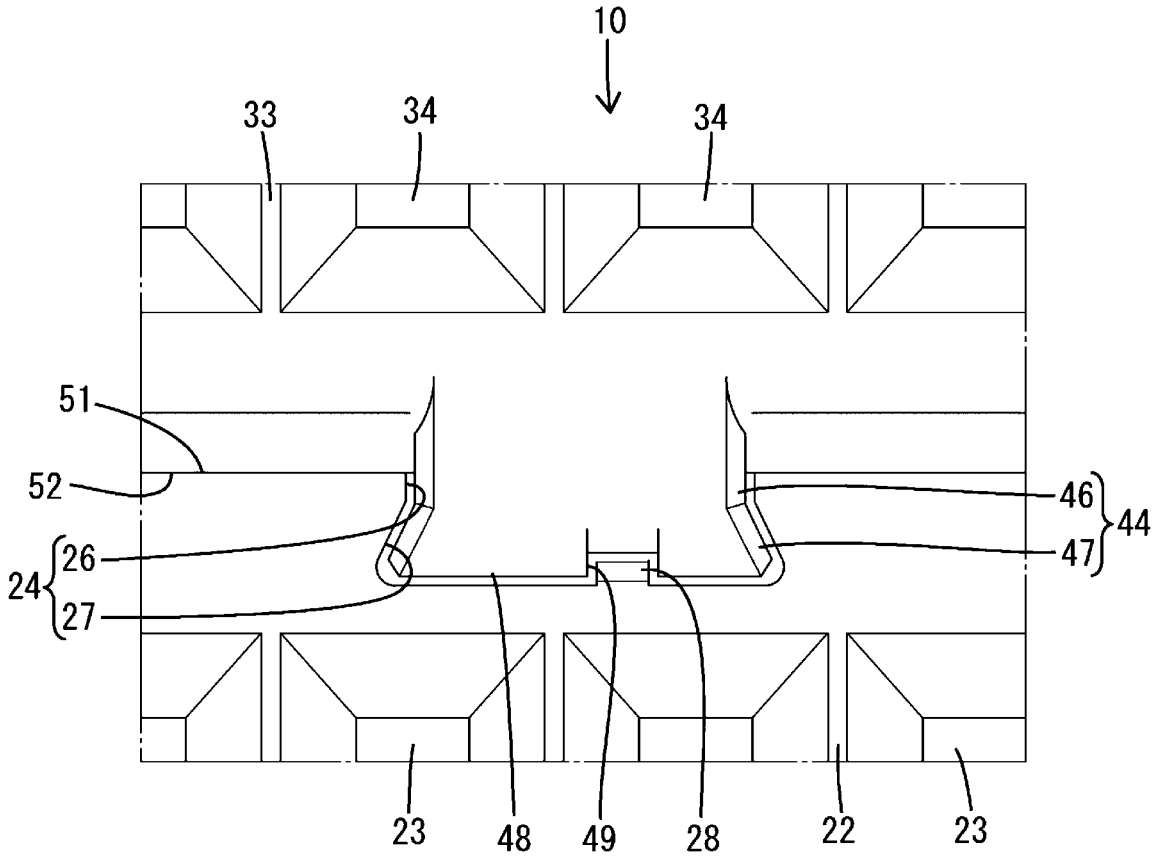
FIG. 12 is an enlarged front view showing a state where the locking portion is fit and locked to the lock receiving portion.

The locking portion 44 includes a base portion 46 on an upper end side (base end side in a projecting direction) and a restricting portion 47 wider than the base portion 46 on a lower end side (tip side in the projecting direction). The base portion 46 is shaped to project downward from the front wall 33 while having a constant width. The restricting portion 47 is shaped to gradually increase a width from the base portion 46 toward the tip side. As shown in FIG. 12, the locking portion 44 has a dovetail shape fittable into the lock receiving portion 24.

As shown in FIG. 7, the lower surface (surface on the tip side in the projecting direction) of the restricting portion 47 has a slope 48 having an arcuate cross-section, inclined forward and connected to the front surface of the locking portion 44 without any step. The slope 48 of the restricting portion 47 has the same curvature as the lower surface of the rotating portion 43. The restricting portion 47 includes a groove-like recess 49 extending in the front-rear direction at a position shifted toward one side from a widthwise center of the slope 48. The recess 49 is shaped by cutting a lower end part of the restricting portion 47 in the front-rear direction.

The back surface of the recess 49 is arranged to be flat along the front-rear direction. Since the recess 49 is open in the slope 48, a rear end side is recessed deeper than a front end side. The protrusion 28 is fittable into the recess 49.

(Coupling Method and Coupling Structure of First Housing 11 and Second Housing 12)

Figure 8:
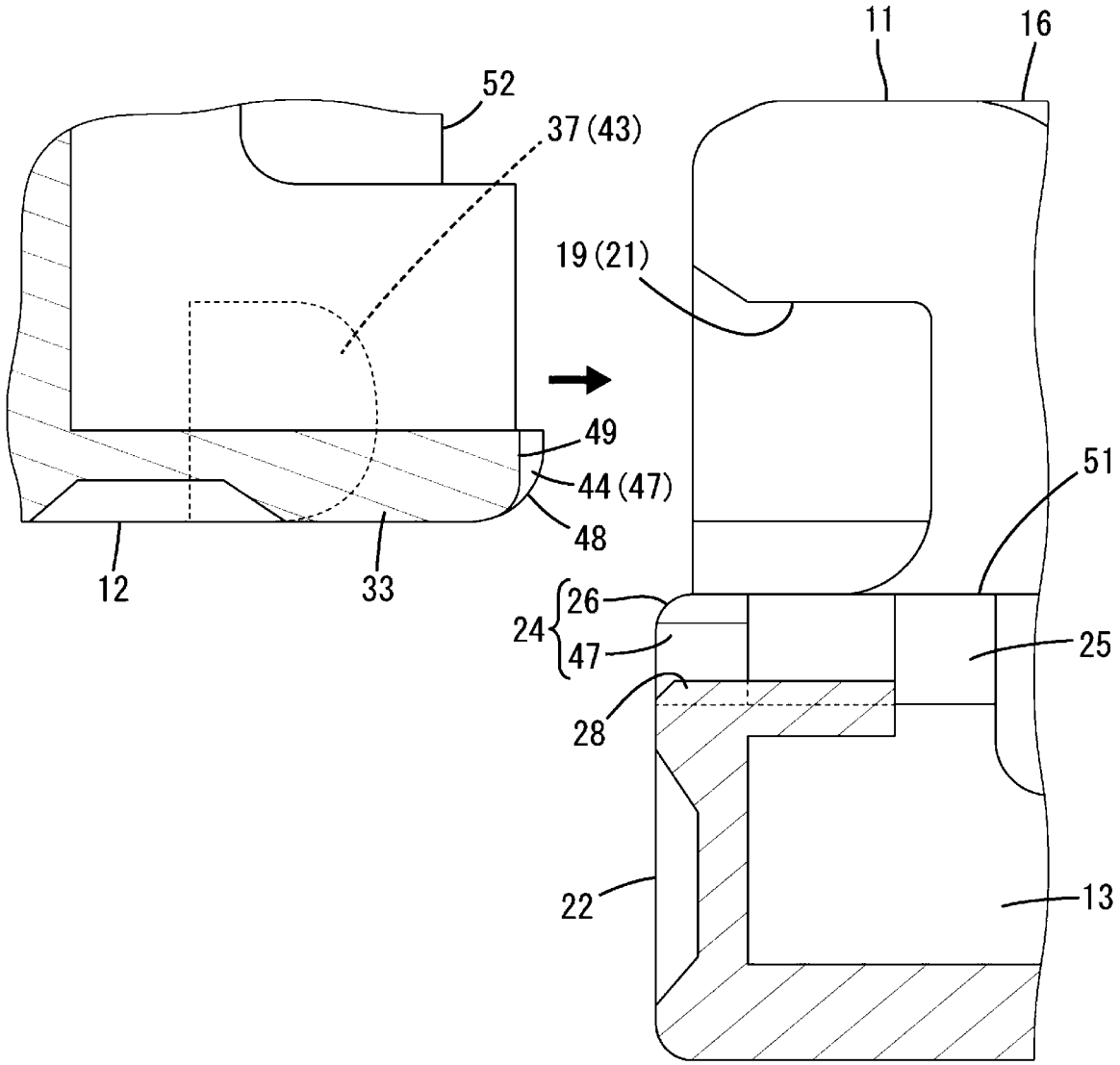
FIG. 8 is an enlarged section showing a state before the first and second housings are coupled.

In coupling the first and second housings 11, 12, the second housing 12 is arranged in front of the first housing 11 as shown in FIG. 8 while being in such an upright or inclined posture that the rear wall 36 is facing upward. In that state, the second housing 12 is moved rearward (direction of an arrow in FIG. 8). Then, the rotating portions 43 of the second fulcrum portions 37 are inserted into the receiving portions 21 of the first fulcrum portions 19 from front as shown in FIG. 9. Thick parts of the first fulcrum portions 19 are inserted into the recessed grooves 42 of the second fulcrum portions 37. At this time, the locking portion 44 is in a horizontal posture along the front-rear direction and arranged above the lock receiving portion 24.

By the contact of the rotating portions 43 with the inner surfaces of the receiving portions 21, a movement of the second housing 12 is restricted and the second housing 12 is stopped at an initial position with respect to the first housing 11.

Figure 10:
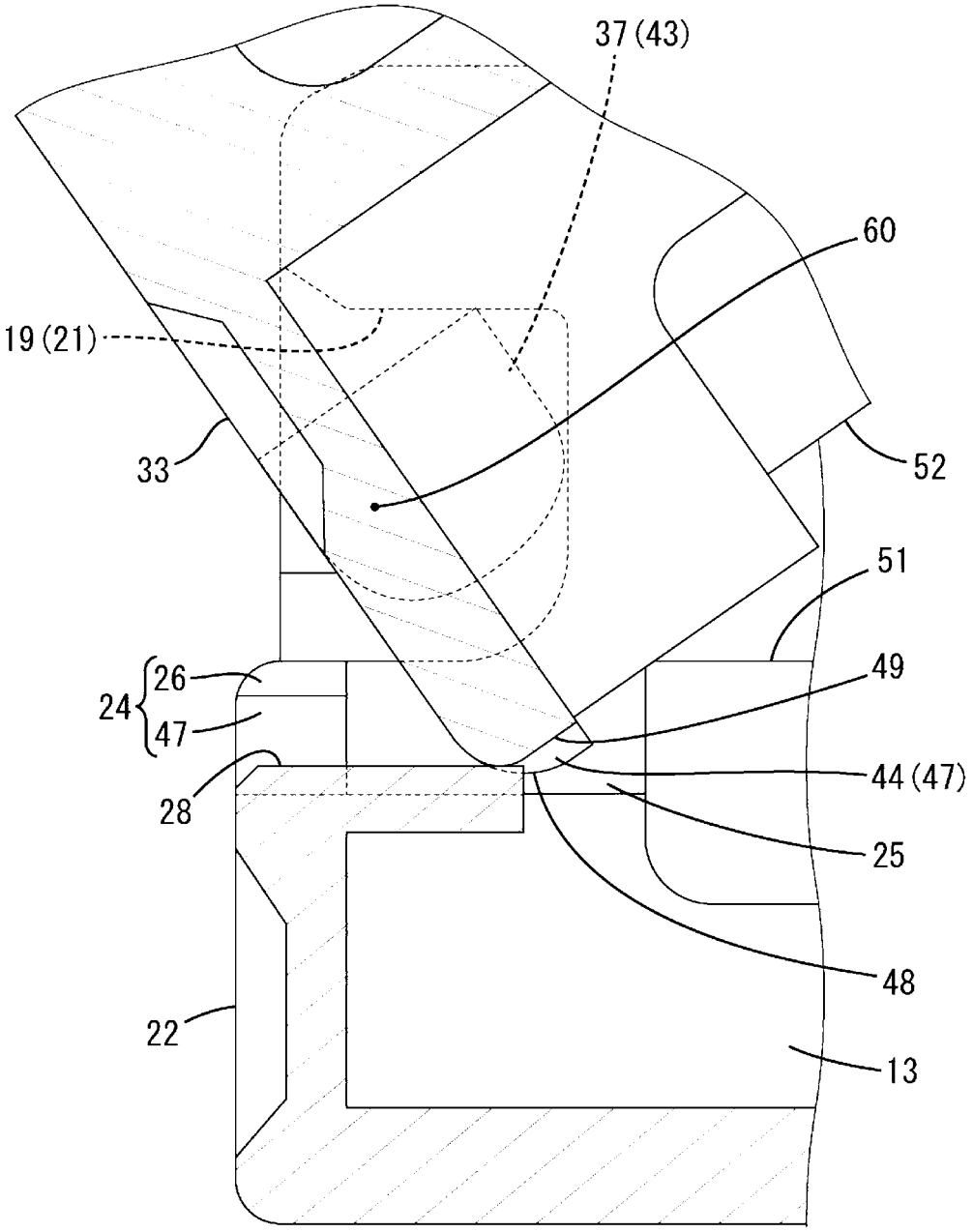
FIG. 10 is an enlarged section showing an intermediate state while the second housing is being rotated from the initial position toward a coupling position with respect to the first housing.
Figure 11:
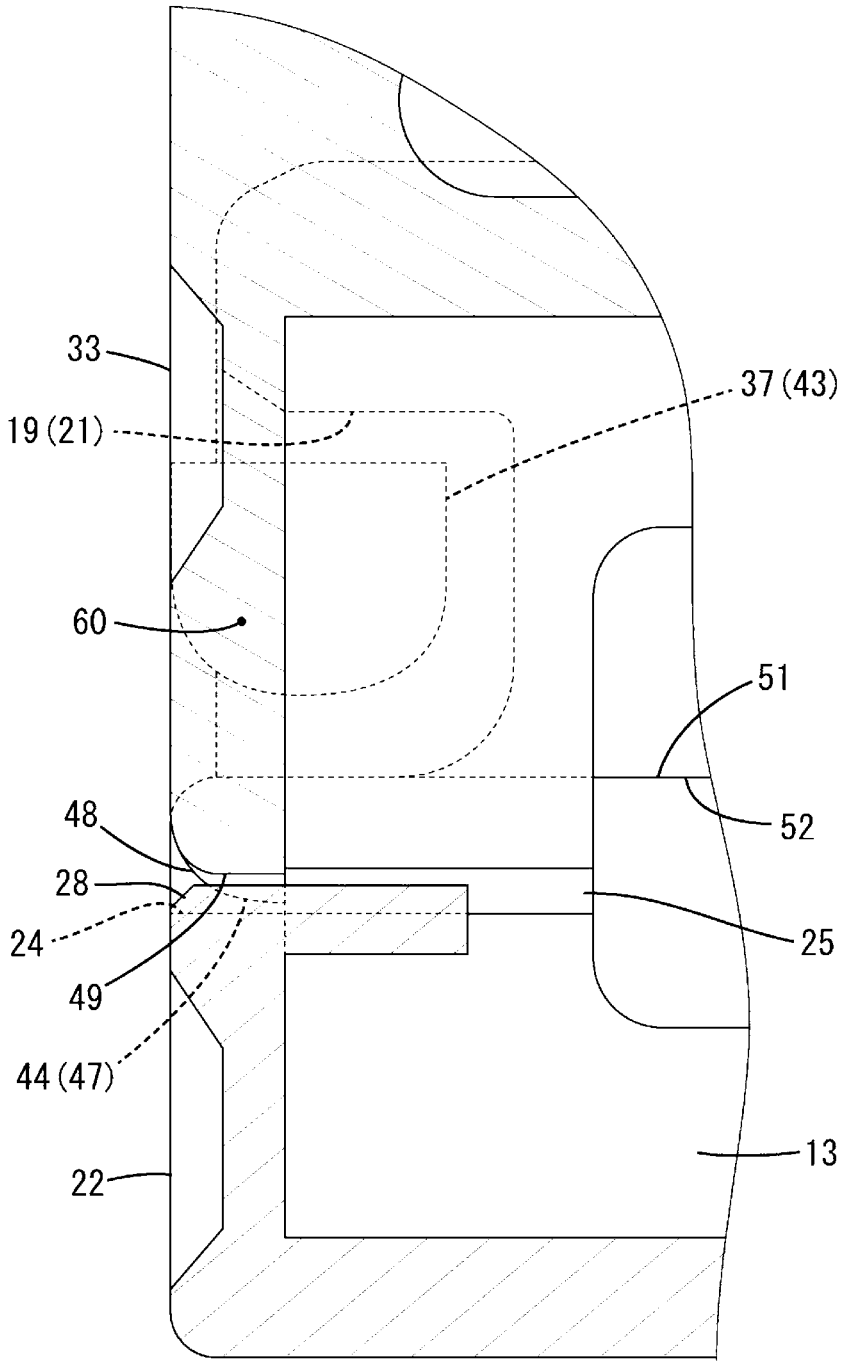
FIG. 11 is an enlarged section showing a state where the first and second housings have reached the coupling position.

Subsequently, as shown in FIGS. 9 to 11, the second housing 12 is rotated with respect to the first housing 11 about a virtual axis of rotation 60 passing through the rotating portions 43 in the receiving portions 21 and extending along the width direction at engaged positions of the first and second fulcrum portions 19, 37. In this case, the axis of rotation 60 is not fixed at a certain position and is displaceable in clearance ranges in the receiving portions 21. As the second housing 12 is rotated toward a coupling position with respect to the first housing 11, the mutually facing surfaces 51, 52 approach each other.

Further, as shown in FIGS. 9 to 11, the locking portion 44 is also displaced from the horizontal posture toward an upright posture in the process of rotating the second housing 12 with respect to the first housing 11. In the process of rotating the locking portion 44, the base portion 46 is positioned and inserted into the opening 26 from behind and the restricting portion 47 is positioned and inserted into the restriction receiving portion 27 from behind. In short, the locking portion 44 is fit into the lock receiving portion 24 from behind. Since the lower surface of the restricting portion 47 is formed with the arcuate slope 48 corresponding to a rotation locus of the restricting portion 47, the interference of the restricting portion 47 with the restriction receiving portion 27 in the rotating process of the restricting portion 47 is avoided. Further, the protrusion 28 is positioned and inserted into the recess 49 in the rotating process of the restricting portion 47.

When the second housing 12 is rotated to reach the horizontal posture, the first and second housings 11, 12 are stopped at the coupling position by the locking of the first and second lock projections 18, 41 after the first lock portions 17 are deflected and deformed.

The first and second housings 11, 12 are arranged in parallel so that the mutually facing surfaces 51, 52 can contact each other at the coupling position. The first and second housings 11, 12 are held in a separation restricted state at the coupling position by maintaining the locked state of the first and second lock portions 17, 38 on the both widthwise end sides of the rear end parts, maintaining the fit state of the first and second fulcrum portions 19, 37 on the both widthwise end sides of the front end parts and maintaining the fit state of the locking portion 44 and the lock receiving portion 24 on the widthwise central sides of the front end parts. Further, as shown in FIG. 11, a clearance is formed between the slope 48 of the restricting portion 47 and the back surface (surface denoted by 24 in FIG. 11) of the restriction receiving portion 24.

With the first and second housings 11, 12 held at the coupling position, an opening part of the facing surface 51 of the first housing 11 is closed by the second housing 12, the second detecting portions 31 enter the first cavities 13 and the terminal fittings 20 in the first cavities 13 are secondarily retained by the second detecting portions 31 as shown in FIG. 13. Similarly, an opening part of the facing surface 52 of the second housing 12 is closed by the first housing 11, the first detecting portions 14 enter the second cavities 29 and the terminal fittings 20 in the second cavities 29 are secondarily retained by the first detecting portions 14. By the rotation of the first and second housings 11, 12 about the axis of rotation 60, a state where the second detecting portions 31 enter the first cavities 13 through the opening part of the facing surface 51 and the first detecting portions 14 enter the second cavities 29 through the opening part of the facing surface 52 can be satisfactorily realized.

If a worker pinches the respective wires 31 pulled out rearward with fingers with the first and second housings 11, 12 held at the coupling position, such a force as to separate the mutually facing surfaces 51, 52 acts on the first and second housings 11, 12. In this case, since the first and second housings 11, 12 are shaped to be long in the width direction, there is a concern that so-called opening between the mutually facing surfaces 51, 52 occurs at the widthwise central side.

However, in the case of this embodiment, since the locking portion 44 is fit to the lock receiving portion 24 and a widened part of the restricting portion 47 is locked to a widened part of the restriction receiving portion 27 from below as shown in FIG. 12, the occurrence of the opening between the mutually facing surfaces 51, 52 of the first and second housings 11, 12 can be suppressed.

As just described, according to this embodiment, in coupling the first and second housings 11, 12, the rotating portions 43 are inserted into the receiving portions 21 from front and, subsequently, the restricting portion 47 is fit and locked to the restriction receiving portion 27 in conjunction with the rotation of the first and second housings 11, 12 about the axis of rotation 60 passing through the rotating portions 43. In this way, the escape of the locking portion 44 from the lock receiving portion 24 is restricted and, consequently, the occurrence of the opening between the mutually facing surfaces 51, 52 of the first and second housings 11, 12 can be suppressed.

Further, since the slope 48 inclined forward is provided on the lower surface of the restricting portion 47, the interference of the restricting portion 47 and the restriction receiving portion 27 can be avoided and a rotating operation of the first and second housings 11, 12 can smoothly proceed. Further, since the slope 48 of the restricting portion 47 is curved toward the back surface of the restriction receiving portion 27, the rigidity of the restricting portion 47 is enhanced by as much as the slope 48 is curved.

Further, by fitting the protrusion 28 to the recess 49, it is possible to effectively suppress the locking portion 44 and the lock receiving portion 24 from being displaced in the width direction.

Other Embodiments of Present Disclosure

The embodiment disclosed this time should be considered illustrative in all aspects, rather than restrictive.

Although the first housing is provided with the receiving portions and the second housing is provided with the rotating portions in the case of the above embodiment, a first housing may be provided with rotating portions and a second housing may be provided with receiving portions as another embodiment.

Although the first housing is arranged below the second housing in the case of the above embodiment, a first housing may be arranged above a second housing as another embodiment. Alternatively, a first housing and a second housing may be arranged side by side in the width direction.

Although the restricting portion is provided with the recess and the restriction receiving portion is provided with the protrusion in the case of the above embodiment, a restriction receiving portion may be provided with a recess and a restricting portion may be provided with a protrusion as another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising a first housing and a second housing having facing surfaces facing each other, wherein:

one of the first and second housings includes a receiving portion open forward in a front end part and the other includes a rotating portion to be arranged in the receiving portion in the front end part, the second housing is rotated with respect to the first housing about an axis passing through the rotating portion in the receiving portion along a width direction and is coupled to the first housing, the first housing includes a lock receiving portion open forward and rearward and recessed toward a side away from the second housing in the front end part, the second housing includes a locking portion projecting toward the first housing and to be fit to the lock receiving portion in the front end part, the locking portion includes a restricting portion wider than a base end side in a projecting direction on a tip side in the projecting direction, and the lock receiving portion includes a restriction receiving portion wider than an opening end side in a recess direction on a back end side in the recess direction.

2. The connector of claim 1, wherein:

the lock receiving portion is arranged on a central side in the width direction of the first housing and the locking portion is arranged on a central side in the width direction of the second housing, and the first housing includes first lock portions on both end sides in the width direction and the second housing includes second lock portions on both end sides in the width direction, the second lock portions being locked to the first lock portions to hold the first and second housings in a coupled state.

3. The connector of claim 1, wherein a slope inclined forward is provided on an end side on a tip side in the projecting direction of the restricting portion.

4. The connector of claim 3, wherein the slope of the restricting portion is curved toward a back surface of the restriction receiving portion.

5. The connector of claim 1, wherein either one of the restriction receiving portion and the restricting portion is provided with a protrusion projecting toward the other, and the other is provided with a recess to be fit to the protrusion.

* * * * *